United States Patent [19]

Mitchell

[11] 4,002,096

[45] Jan. 11, 1977

[54] MUSICAL INSTRUMENT

[75] Inventor: William Mitchell, Toronto, Canada

[73] Assignee: Lawrence Peska Associates, Inc., New York, N.Y. ; a part interest

[22] Filed: Jan. 19, 1976

[21] Appl. No.: 650,056

[52] U.S. Cl. ..... 84/380 R

[51] Int. Cl.[2] ..... G10D 7/00

[58] Field of Search ..... 84/380 R, 386

[56] References Cited

UNITED STATES PATENTS

| | | | |
|---|---|---|---|
| 264,891 | 9/1882 | Marshman | 84/380 |
| 1,615,961 | 2/1927 | Smith | 84/380 |
| 1,670,775 | 5/1928 | Loomis | 84/380 |
| 3,308,706 | 3/1967 | Brilhart | 84/380 |

FOREIGN PATENTS OR APPLICATIONS

| | | | |
|---|---|---|---|
| 78,957 | 1/1895 | Germany | 84/380 |

*Primary Examiner*—Stephen J. Tomsky

[57] ABSTRACT

This disclosure pertains to a novel wind instrument having a range of two octaves. Seven lettered note keys, starting with C, each can be individually depressed to produce a tone. An octave bar, when simultaneously depressed, produces the corresponding tone in the next higher octave. Scale programming buttons, when once depressed, select a sharp, natural, or flat tone which is now produced when depressing the lettered note key, in accordance with the composition's key signature. Means are provided to quickly reset the program by first making all lettered note keys natural and upon further simple manipulation, selection of the new scale program may be obtained. To avoid disturbing the program set by the scale buttons, a group of buttons provides tones in an accidental register which, upon their depression, will produce accidental notes not included in the main key. Accidental buttons are depressed for desired varient notes in the composition, supplanting depression of the corresponding preprogrammed lettered note keys when the composition so requires. The accidental register is comprised of a standard octave including flats and sharps, matching the tone capabilities of the lettered note keys. All the tones produced are emitted from a bell-shaped cavity.

11 Claims, 10 Drawing Figures

MUSICAL INSTRUMENT

BACKGROUND OF THE INVENTION

1. The Field of the Invention

This invention relates to musical instruments in the wood wind class.

2. Description of the Prior Art

Wood wind instruments have been devised for many many centuries and have taken a variety of shapes and modes of construction. In the main, however, manually operated instruments required the musician to mentally transpose notes indicated on the score from the designated note to the required note, in accordance with the composer's instructions as shown in the key signature. Complex key scales required mental agility and for longer compositions, sustained retention of key signature information.

SUMMARY OF THE INVENTION

This invention involves a wood wind instrument comprised of a series of holes located along the length of a tube. Air passes through the holes emitting tones dependent on the physical location of the holes. The tube is terminated in a bell-like sound emitting structure. Lettered note keys, once depressed, elevate note pads located sequentially along the length of the tube. Each note pad operated by each lettered note key exposes an area in which three holes, sequentially located along the axis of the tube, are located. The central hole represents the natural tone corresponding with its lettered key. The adjacent holes can produce the flat or sharp tone for the same lettered tone. A mechanism is provided to uncover movable slide covers such that only one of the three holes under one note pad may be uncovered at any one time. This mechanism permits the note key depression to then produce a note in accordance with the position of the slide covers, that have been programmed in accordance with the instructions given by the key signature. On those occasions that the composer requires that one note be played occasionally which is not in accordance with the programming and therefore out of the key, an accidental button may be depressed which opens up a small pad covering a single hole in a series of small holes, sequentially located along the length of the tube, thus producing tones corresponding to a full octave including its flat and sharp notes. This eliminates modifying the location of the slide covers for those rare occasions that an accidental tone has to be produced.

Two scale buttons, by virtue of the unique construction of the apparatus, upon their depression, close all the half tone slide covers and open all the central full tone natural slide covers, thereby permitting the instrument to play only natural tones, corresponding with the lettered note keys. Then, individual flat and sharp scale buttons may open the slide covers for a half tone and close the holes capable of producing the natural tone for each lettered note key. The instrument is thus programmed in accordance with the key signature. A bar running the length of the lettered note keys operates a single note pad to open a single hole, thus producing tones one octave higher than the tone capabilities of the note keys below. The instrument thus has a range of two octaves.

A primary object of the instant invention is to provide a musical instrument semi-permanently programable to provide tones designated by the key signature of a composition eliminating the need for mental transposing.

Another object is to provide a wood wind instrument capable of producing accessory tones without disturbing the key setting mechanism.

Still another object is to provide a wood wind instrument which naturalizes all the tones when depressing two scale buttons.

A further object is to provide a wood wind instrument which raises each note an octave higher upon depressing a single octave bar.

Another object is to provide a wood wind instrument complete with a mechanism quickly programming the natural tone to either associated half tone.

These objects, as well as other objects, of this invention will become readily apparent after reading the following description of the accompanying drawings.

DESCRIPTION OF THE PREFERRED EMBODIMENT

Figure 1:
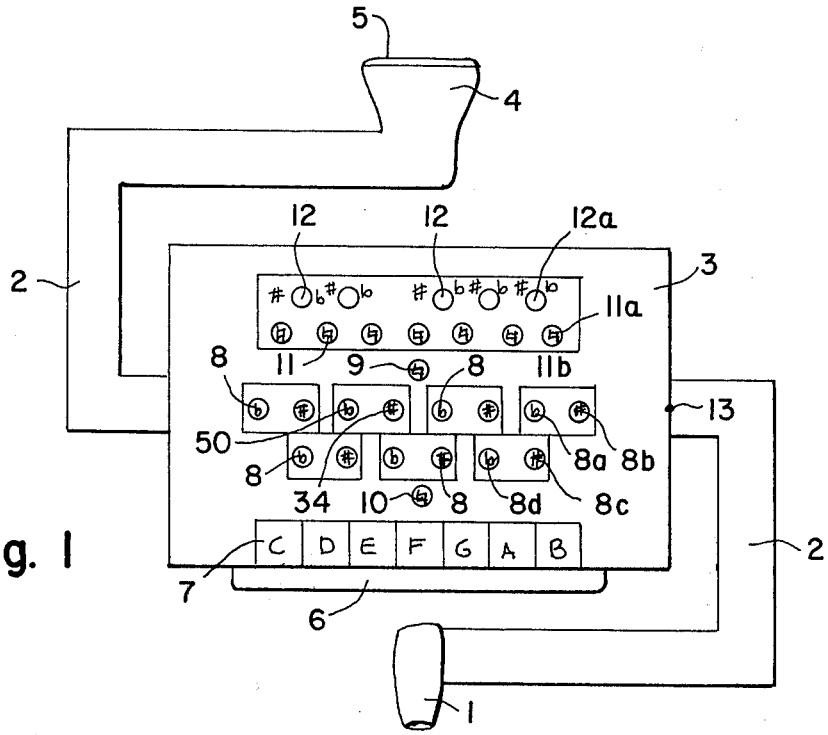
FIG. 1 is a plan view of the instrument.

The structure and method of fabrication of the present invention is applicable to a wood wind instrument comprising a mouthpiece and a hollow main tube terminating in a bell-shaped sound emitting structure. A portion of the tube passes through a rectangular enclosure. The uppermost surface of the enclosure is adapted with seven indepedent lettered note keys spring biased into an undepressed position. A series of flat and sharp scale programming buttons are provided in conjunction with two naturalizing programming buttons. Each lettered note key, with the exception of the C note, operates a note pad covering an area of the main tube within the enclosure. Beneath each note pad are three holes in the main tube which in turn are covered by three slide covers positioned between the note pad and the surface of the main tube. Upon first positioning a slide cover to uncover one of the three holes and later lifting the note pad by depressing the note key, a tone can be produced dependent upon the position along the length of the tube of the hole so uncovered. Typically, the lettered note D, when depressed, can produce the tones of D flat, D natural, or D sharp comprising the total D tonal group, dependent solely upon which slide cover is used to expose the hole to produce the desired tone within the D tonal note group. The two naturalizing note programming buttons are each capable upon depression of operating simultaneously a number of central slide covers. One naturalizing note programming button operates four central slide covers while the other naturalizing note programming button is capable of mechanically operating the remaining three slide covers. Depression of either naturalizing note programming button uncovers all of the central natural tone producing holes in that group and simultaneously re-covers all the slide covers previously positioned to uncover half tone producing holes in the same group. Thus by depressing both naturalizing note programming buttons, the instrument is returned into the key of C natural and depression of any lettered note key produces the natural tone of that note key.

The instrument is programmed to correspond to the key desired by the composer by depressing the individual flat and sharp scale programming buttons in accordance with the key signature of the composition. When, for example, the B flat note programming button is depressed, the mechanism automatically re-covers the central hole with the central slide cover and simultaneously uncovers the hole capable of producing B flat. Now when the lettered note key B is depressed, the tone B flat will automatically be produced and will continue to be produced upon each subsequent depression of the B note key until the instrument is re-programmed by depressing the two naturalizing note programming buttons, returning the instrument to the key of C major. The instrument is now ready to be re-programmed into another key by depressing the appropriate individual note programming button. Should the key of D major be desired, the instrument would first be naturalized and the individual note programming buttons denoting F sharp and C sharp would be depressed. The instrument is now programmed for the key of D major. To convert the instrument to the key of E major, the instrument is again naturalized by depressing both naturalizing note programming buttons, followed by individually depressing the note programming buttons for F sharp, G sharp, C sharp, and D sharp. Depression of lettered note key G will produce the note G sharp, while the depression of the lettered note E will produce E natural since neither the E flat nor the E sharp programming buttons have been depressed during the preceding programming operation.

The lettered note keys C, E, G, and B have their associated note pads and individual tone producing holes sequentially and uniformly spaced along a line, parallel to the axis of the main tube, on the uppermost surface of the main tube, when in a horizontal position. This line is parallel but radially displaced to the central line in the horizontal main tube which is uppermost on its surface. Thus the central line and the longitudinal axis of the main tube define a vertical plane. Another line radially displaced from the central line on the side opposite to the line of holes capable of producing the C-E-G-B notes, have note pads and tone producing holes similarly uniformly spaced interstitial to the C-E-G-B holes and are capable of producing the notes D, F, and A.

C sharp and D flat are the same tone. The slide cover which produces C sharp and the slide cover which produces D flat are positioned adjacent each other, on opposite sides of the central line, and along a line transverse thereto. This longitudinal positioning detail is true for all the corresponding intermediate flat and sharp tone producing holes and their associated slide covers. Thus, greater ease is provided in programming the instrument.

Because the instrument itself is tuned in the key of C natural, there is no need to provide a central natural tone producing hole in the C note grouping. However, the mechanism which naturalizes the C-E-G-B group of notes is capable of contacting a C natural half slide cover. This is necessary in order to return the C flat or C sharp slide covers to the closed position when depressing the C-E-G-B naturalizing note programming button. The C note pad uncovers two full length slide covers, each associated with an individual flat or sharp tone producing hole, and operates a half slide cover which does not have an associated tone producing hole. In contrast, the remaining six lettered note keys each control an individual note pad which covers three slide covers within a tonal group encompassing the lower or flat tone producing hole, the central or natural tone producing hole, and the upper or sharp tone producing hole.

The range of the instrument is extended an octave higher by lifting a single note pad intermediate the mouthpiece end of the main tube and the B sharp note programming button. This single note pad is operated by an octave bar which is conveniently located on the side wall of the enclosure adjacent to the individual lettered note keys. When, for example, the note key E is depressed, having been previously programmed to produce E natural, while simultaneously depressing the octave bar, an E natural tone one octave higher will be produced.

The plane defined by the uppermost longitudinal line on the upper surface of the main tube and the line representing its longitudinal axis intersects the tube along a line at its lowermost surface. A series of twelve sequentially spaced holse are located in the lowermost surface about the lowermost line. Each hole is covered by an individual accidental note pad. Each pad in turn connects to a mechanism adapted to lift an individual accidental note pad upon depression of one of a series of accidental buttons located on the uppermost surface of the enclosure. Seven of the accidental buttons produce the natural tones equivalent to the seven lettered note keys by locating the seven accidental note pads along the length of the main tube in a corresponding position along the longitudinal length, corresponding to the central natural tone producing holes for each of the lettered note keys. An intermediate accidental unitary flat/sharp note pad is located between each of the seven accidental natural note pads with the exception of the intermediate pad between the accidental note pads for E natural and F natural. The intermediate accidental note pads produce the sharp tone of the natural note below it and the flat tone of the natural note above it concurrently. This is contrasted with the individual note programming button scheme which provides a button capable of producing the sharp tone above a natural note and an individual note programming button, coincident in tone, for the flat tone of the natural note above it. The purpose of the duplicating effects of two similar tone producing mid natural tone programming buttons is to simplify a rapid programming or reprogramming procedure. On using the accidental buttons, the user may on occasion be forced to mentally transpose the fact that the sharp of a lower natural tone corresponds to a flat of the next highest natural tone, thus requiring him to depress the sharp/-flat accidental button.

The note key pads have a diameter approximating the inside diameter of the main tube which covers a longitudinal length of the tube, including the three holes in the tonal group capable of producing the flat, natural, and sharp tones of a lettered note key. The accidental buttons control accidental note pads whose diameter is substantially smaller than the lettered note key pads and individually cover single holes capable of producing the natural lettered note tone or the intermediate sharp/flat tone, excepting the E sharp/F flat tone which is not required. The octave note pad and its associated appropriate diameter hole is positioned to create the octave raising effect desired along the main tube intermediate the mouthpiece and the B sharp programming slide cover.

Each individual note programming button is fitted to a slide cover positioning shaft normal to the horizontal uppermost surface of the enclosure. Similarly, each of the two naturalizing note programming buttons are coupled to a group of vertical slide cover positioning shafts. All of the vertical slide cover positioning shafts are biased upwards with springs sustaining them in an uppermost undepressed position. The lowermost end of each slide cover positioning shaft, when its associated button is depressed, contacts a vertical protrusion normal to the plane of each slide cover. When a slide cover positioning shaft is depressed fully, the slide cover related thereto uncovers its associated tone producing hole. One scale changing mechanism is provided for each tonal group consisting of three associated slide covers, that is, one utilized for the lower half tone, one for the natural tone, and one for the upper half tone. The mechanism further consists of two stationary fingers each containing a transverse frictionless eyelet and two lengths of wire, each having a free end fastened to the projection on the central slide cover - used to uncover the central hole which produces the natural tone in that tonal group. Each wire is threaded through an eyelet and has the other free end fastened to the projection on the slide cover which is associated with the holes capable of producing the lower or upper half tone in the same tonal group.

Upon depressing a central slide cover positioning shaft, displacement of the central slide cover occurs which uncovers the central natural tone producing hole in that tonal group. Concurrently, tensioning forces are established at the ends of the two wires fastened to the projection on the central slide cover such that both half tone slide covers in the same tonal group are forced to cover their respective half tone producing holes. Upon later depressing either associated half tone slide cover positioning shaft, only one wire is tensioned which forces the center slide cover to cover the center natural tone producing hole, while slack is created in the other wire. Should the other half tone slide cover positioning shaft be depressed at a later time, that associated slide cover will uncover its associated half tone producing hole as well, resulting in a situation where one note pad would have the two holes representing the flat and sharp of the natural tone group uncovered at the same time. This produces usually an unwanted sound. To avoid this unwanted tone, it is necessary to insure that only one of the three associated slide covers within a tonal group expose a single hole under its note pad at any one time. To expeditiously convert the tone emitted within a given tonal group from a preprogrammed half tone to either the natural tone or the other half tone, the instrument is first returned to an unprogrammed condition of C major. To bring the instrument into the key of C major, all the central holes excepting C must be uncovered whilst all the sharp and flat tone producing holes in all groups must be covered. Since a central slide cover positioning shaft controlling the slide cover which covers the central natural tone producing hole has the capability, when depressed, of recovering both or either half tone producing holes in that group previously uncovered, the mechanism is adapted to facilitate rapid reprogramming in the key of C natural by ganging together a number of central slide cover positioning shafts controlling the central slide covers. This is accomplished by ganging together four central slide cover positioning shafts for the central slide covers capable of uncovering the natural tone producing holes for C natural, though no C natural hole exists, E natural, G natural, and B natural, thereby providing manual manipulation to the ganged assembly of natural tone slide cover positioning shafts by providing a single naturalizing note programming button for the tonal group C-E-G-B. Similarly, central slide covers for the natural tones of D, F, and A cover the D-F-A natural tone producing holes because the individual natural D-F-A slide cover positioning shafts are ganged together and controlled by the other naturalizing note programming button. Thus, by depressing both naturalizing note programming buttons, all half tone slide covers are returned or maintained in the hole covering position and all six of the full slide covers uncover the central natural tone producing holes, excepting the half slide employed in the C tonal group which does not have a C natural tone producing hole.

Now referring to the Figures, and more particularly to the embodiment illustrated in FIG. 1 showing the instrument in plan view illustrating the mouthpiece 1, the main tube 2, which enters the enclosure 3. After passing through the enclosure, the main tube terminates in a horn or bell-like structure 4 from which the sound is emitted at 5. An octave bar 6 is depressable anywhere along its length, lifting a pad, not shown, by use of a suitable linkage, which exposes a hole in the main tube 2 nearest the righthand side of the enclosure. Lettered note keys 7 are lettered from C to B in typical musical ascending order and are individually depressable, operating two rows of note pads by use of suitable linkage mechanisms within the enclosure. The C-E-G-B note keys operate the note pads on a line parallel to the axis of the tube within the enclosure which is farthest from the mouthpiece. Similarly, note keys D-F-A operate the note pads on a line parallel to the axis of the tube within the enclosure which is closest to the mouthpiece. Individual note programming buttons 8 are depressable and through a suitable internal linkage, independently operate individual slide covers located between each note pad and individual holes in the main tube. The naturalizing note programming button 9 is depressable and through a suitable internal linkage, operates four individual slide covers each located between the pairs of adjacent individual note programming buttons 8 located in the row farthest from the mouthpiece. Each of the four aforementioned slide covers are located between pairs of associated sharp and flat individual note programming buttons. The naturalizing note programming button 10 is depressable and through a suitable internal linkage, operates three individual slide covers each located between the pairs of adjacent individual note programming buttons 8 located in the row closest to the mouthpiece. Each of the three aforementioned slide covers located on the line closest to the mouthpiece, are positioned between pairs of associated sharp and flat individual note programming buttons in that line. Both rows of note pads are positioned on the uppermost surface of the main tube 2 within the enclosure, along the two lines which are located somewhat below and on opposite sides of the uppermost longitudinal line, extending from right to left on the surface of the tube. A series of seven individually operated accidental buttons 11 operate a series of uniformly spaced accidental note pads located on the undermost surface of the main tube along a line parallel to the longitudinal axis of the main tube within the enclosure. Five intermediate accidental sharp/flat note buttons 12 operate accidental note pads located on the same line that the accidental note pads operated by accidental buttons 11 are located. Each sharp/flat accidental note button 12 operates an individual accidental note pad between the pairs of accidental note buttons 11 closest to it.

All note pads close on the hole or holes they cover when the key or button that operates them is depressed. The linkage for all note pads is such that any note pad linked to a button or key will remain open for a period of time that the button or key is depressed and will close when the button or key is released and becomes undepressed.

Point 13 denotes a point on the longitudinal axis on the main tube 2 where it is intersected by the plane representing the right-hand side surface of the enclosure 3. The various positions of the note pads and the slide covers along the length of the main tube are referable to point 13. Closest to point 13 is a note pad covering a hole in the main tube operated by the octave bar 6. This pad is on the uppermost surface of the enclosed main tube. The next closest note pad is the note pad controlled by the lettered note key B, the center of which covers the holes in the main tube beneath the individual note programming buttons 8*a* and 8*b*. The natural accidental note button 11*a* controls its accidental note pad which is located the same distance from point 13 as the center line of the note pad controlled by the note key B. Accidental sharp/flat button 12*a* controls a note pad the center of which is located in a plane containing the center of the individual note programming buttons 8*a* and 8*c* and the line of separation between the individual lettered note kays A and B. This plane is transverse to the longitudinal axis of the main tube within the enclosure. In similar fashion, the center of the note pad that covers the holes beneath the slide covers controlled by individual note programming buttons 8*c* and 8*d* is in a parallel transverse plane containing a point in the center of lettered note key A and the center of accidental note pad controlled by the accidental button 11*b*. Symmetry is observed for the remaining buttons, keys, pads, holes, and slide covers.

Figure 2:
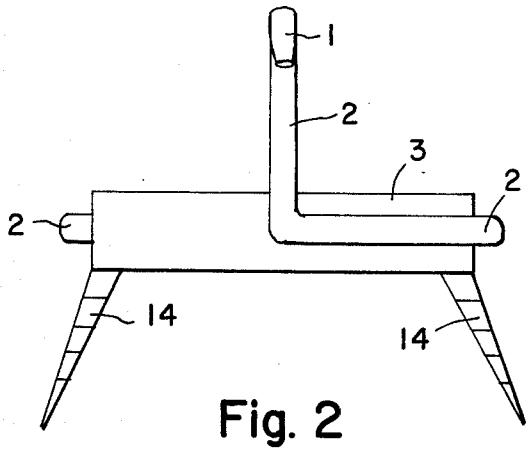
FIG. 2 is a side elevation view as seen by the user.

FIG. 2 illustrates the instrument with the mouthpiece 1 used to supply air to a vertical section of main tube 2. The main tube 2 then proceeds horizontally towards the right of the enclosure entering at the right-hand side face. Legs 14 may be telescopic so as to adjust the height of the enclosure from the floor.

Figure 3:
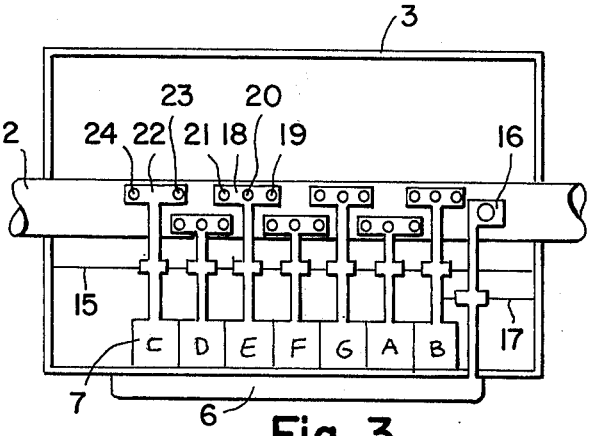
FIG. 3 is a partial plan view illustrating the inner tube, note keys, pivot mechanism, octave bar, note pads, and the container in which the operable mechanisms are located.

FIG. 3 is shown in plan view with the cover of the enclosure 3 and all other mechanisms removed, excepting the note pads controlled by the lettered note keys 7 and their pivot bar 15, and the note pad 16 controlled by the octave bar 6 and its pivot point 17. The note pad 18 controlled by lettered note key E covers three sound holes 19, 20, and 21 machined through the surface of the main tube 2. Note pad 22 covers only two holes 23 and 24.

Figure 4:
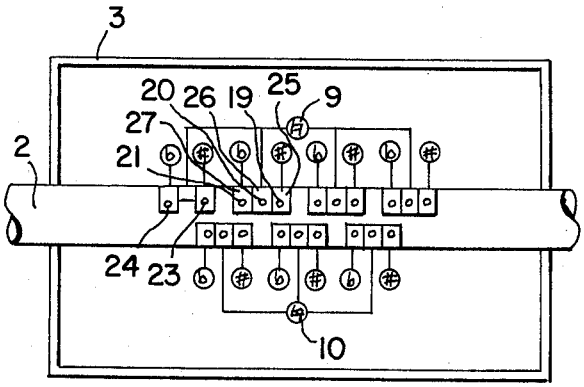
FIG. 4 is a plan view of the slide covers and a portion of the main tube including a diagrammatic representation of two natural scale bars.

FIG. 4 illustrates a cross-section of the enclosure with the main tube 2, with all other mechanisms removed from above the main tube, excepting the slide covers positioned above their related holes. Slide cover 25 slidably covers and uncovers hole 19. Slide cover 26 covers hole 20 in similar fashion. Slide cover 27 slidably covers and uncovers hole 21. Holes 19, 20, and 21 are in the tonal group controlled by the note pad 18, shown in FIG. 3, operated by the lettered note key E, as shown in FIG. 3. The sharp and flat symbols throughout FIG. 4 indicate the tonal sound emitted by their related holes. For example, a sharp symbol is illustrated in conjunction with slide cover 25 and a flat symbol is shown in conjunction with slide cover 27. Slide cover 26 uncovers a hole 20 which produces a natural tone, in this case, E natural. The three holes numbered 19, 20, and 21 emit sounds in the E tonal group only when note pad 18, as shown in FIG. 3, is raised above the surface of slide covers 25, 26, and 27 and when a corresponding slide cover 25, 26, or 27 is positioned so as to uncover its related hole. The instrument is designed to emit a single tone per tonal group at any one time. Four centrally located slide covers in each of the four tonal groups for the letters C-E-G-B are operated by a common naturalizing note programming button 9 as shown in FIG. 1. There is no hole in the lefthandmost C group between holes 23 and 24. The natural tone emitting holes in the center of each of the D-F-A tonal groups are covered or uncovered by their related slide covers which are simultaneously positioned and controlled by naturalizing note programming button 10 as shown in FIG. 1.

Figure 5:
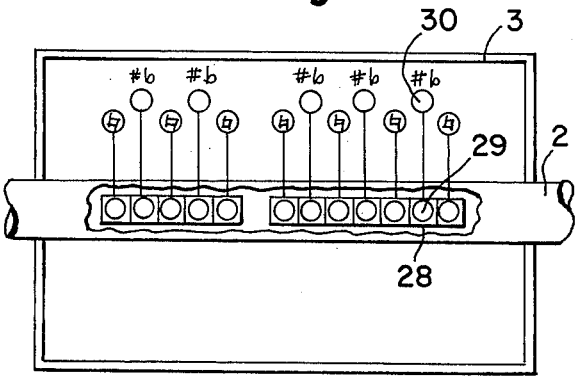
FIG. 5 is a plan view of the accidental register illustrating the note pad covers, a partial length of the main tube, a diagrammatic representation of the notes thereby produced, as viewed from above.

FIG. 5 is a plan view illustrating a portion of the main tube 2 cut away so as to show the accidental note pads contacting the lowermost surface, each covering individual tone producing holes. The accidental sharp/flat button 12*a*, as shown in FIG. 1, operates an accidental note pad 28 covering hole 29 denoted by the sharp/flat notation 30. It is to be noted that one accidental pad and accidental tone producing hole is missing for the tone denoted as E sharp-F flat, which does not exist in the instrument as tuned.

Figure 6:
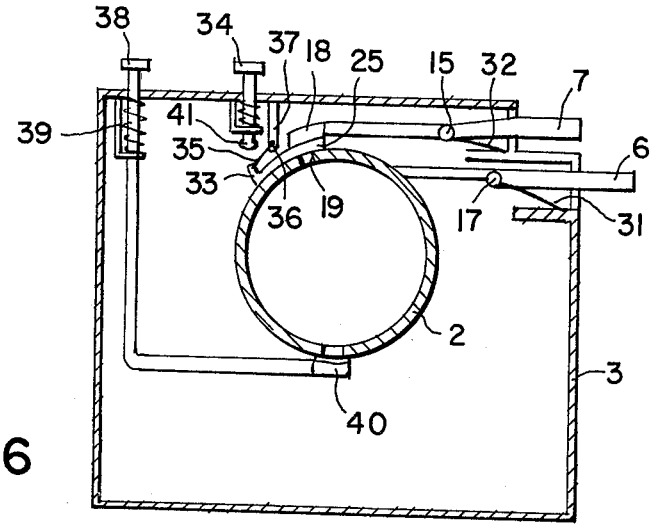
FIG. 6 is a cross-sectional view of the body of the instrument illustrating the mechanism used to produce accidental tones, a note key and its associated note pad, an octave bar, a scale button, a scale changing mechanism, and a scale slide bracket.

FIG. 6 illustrates the octave bar 6 pivotable on rod 17, maintained in the uppermost position by a flat leaf spring 31. The note keys 7 are likewise maintained in the undepressed position by a leaf spring 32 and pivot around pivot bar 15. Typically upon depressing the lettered note key E, note pad 18 will lift from over the body of the main tube 2 breaking contact with the surface of slide cover 25. Slide cover 25 is shown covering hole 19 in the body of the main tube. The slide cover has a projection 33 such that the depression of the sharp individual note programming button 34 in the E tonal group, as shown in FIG. 1, will slidably reposition slide cover 25 exposing hole 19. Projection 33 is connected to a fine wire 35 through an eyelet 36 fastened in a fixed vertical supporting finger 37. One of the accidental buttons 38 is maintained in its uppermost undepressed position by spring 39. Upon depression of the accidental button, the related accidental pad 40 is lowered away from the undermost surface of the main tube 2. FIG. 6 illustrates individual note programming button 34 typical of the programming buttons used to program the uppermost and lowermost half tone notes within the C-E-G-B tonal groups. Slide cover positioning shaft 41 makes contact with slide cover projection 33 when the individual note programming button 34 is depressed. A group of four naturalizing slide cover positioning shafts, not shown, are connected to the naturalizing note programming button 9, as shown in FIG. 1, and operate four natural tone centrally located slide covers within the C-E-G-B tonal groups.

Figure 7:
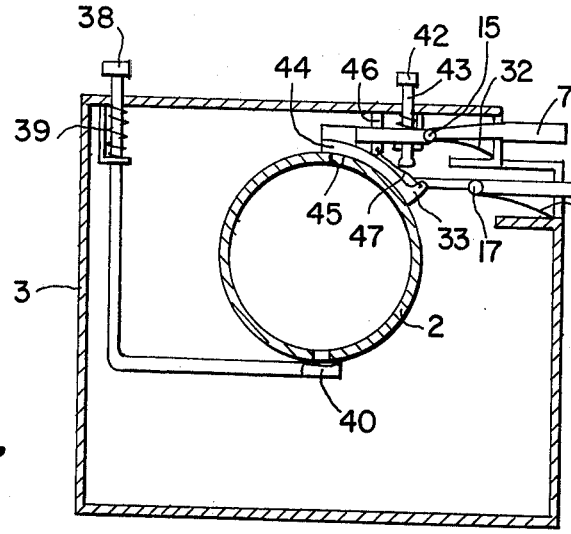
FIG. 7 shows a cross-sectional view of the main body of the instrument identical to FIG. 6 except for the location of the scale button shown intermediate a note pad and its note key.

FIG. 7 illustrates an individual note programming button 42 which, of necessity, is in the D-F-A tonal group. Slide cover positioning shaft 43 engages the projection 33 on slide cover 44 which covers the hole 45 in the main tube. Typically all the individual sharp and flat programming buttons in the D-F-A tonal group are in a line directly behind or in front of individual note programming button 42 as shown. Fixed vertical supporting finger 46 contains an eyelet which encloses a wire 47.

Figure 8:
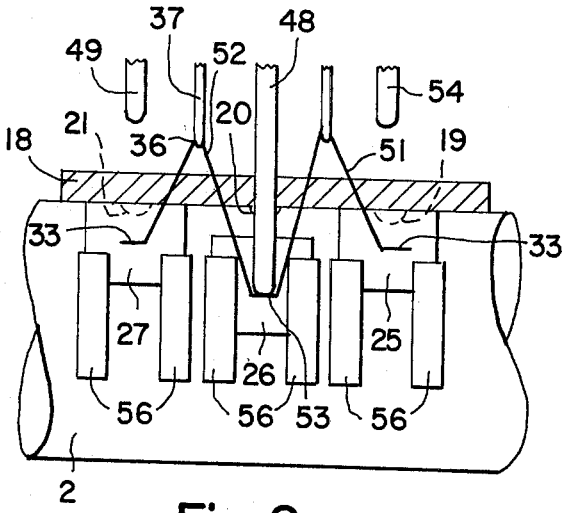
FIG. 8 is a side elevation view of a portion of the tube illustrating the three slide covers, portions of three scale changing rods, the scale changing mechanism, and the note pad adjusted to uncover the natural tone center hole.

FIG. 8 illustrates the slide covers 25, 26, 27 covering respectively holes 19 and 21 with hole 20 illustrated open by virtue of slide cover 26 pushed to its lowermost position by a slide cover positioning shaft 48. Shaft 48 is one of a group of four such shafts ganged together to operate all the central natural tone slide covers in the C-E-G-B tonal group when naturalizing note programming button 9, as shown in FIG. 1, is depressed. Slide cover positioning shaft 49 is coupled to the individual note programming button denoted by number 50, as shown in FIG. 1. Upon depression of shaft 48, wires 51 and 52 are tensioned such that slide covers 25 and 27 are pulled upwards covering holes 19 and 21 respectively. A projection 53 is shown contacting the free end of shaft 48. Projection 33 is fastened to slide cover 27 and may be engaged when shaft 49 is depressed. Note pad 18 covers the area in which holes 19, 20, and 21 are placed and seals hole 20, as shown in the exposed position, despite the fact that slide cover 26 is down in the uncovered position. The slide cover 26, having uncovered hole 20, places the instrument in condition where the tone E natural can be produced. The slide covers 25, 26, and 27 are maintained in tracks 56 such that the slide cover intimately engages the surface of main tube 2.

Figure 9:
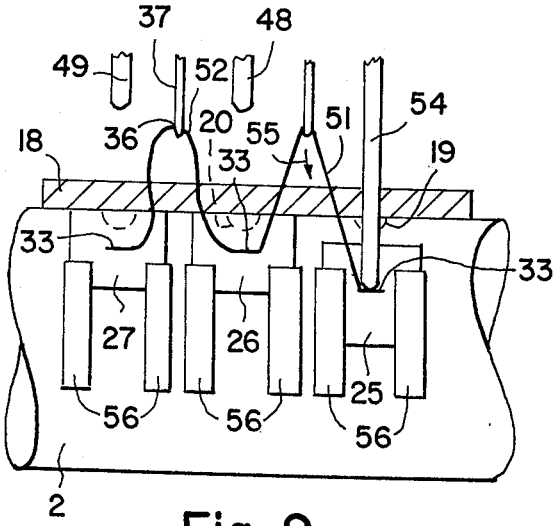
FIG. 9 is a side elevation view of a portion of the tube illustrating the three slide covers, portions of three scale changing rods, the scale changing mechanism, and the note pad adjusted to uncover the hole capable of producing the sharp tone.

FIG. 9 shows the apparatus depicted in FIG. 8 modified by the depression of shaft 54. When the free end of shaft 54 engages the projection 33 on slide cover 25, the hole 19 is exposed. Tension is now exerted in wire 51 in the direction of arrow 55 so as to cause slide cover 26 to move upwards and cover hole 20. Wire 52 becomes slack, though still contained within eyelet 36 of stationary vertical supporting finger 37. At this point, a tone equivalent to E sharp is available by exposing hole 19. FIG. 8 and FIG. 9 illustrate the typical mechanism for each of the seven tonal groups excepting the C tonal group.

Figure 10:
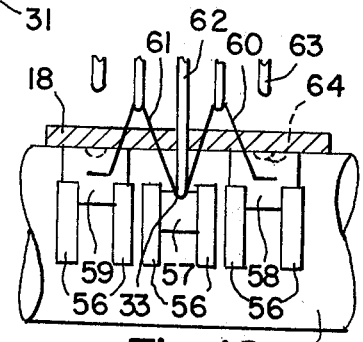
FIG. 10 is a side elevation view of a portion of the tube illustrating the three slide covers, portions of three scale changing rods, the scale changing mechanism, and the note pad adjusted so that the central half slide cover is in the downwardmost position.

FIG. 10 illustrates the deviate form of the mechanism used for the C tonal group. Since there is no C natural tone producing hole, slide cover 57 is shorter in height than slide covers 58 and 59. The sole purpose of slide cover 57 and its vertical projection 33 is to maintain the operability of wires 60 and 61. Naturally, slide cover positioning shaft 62 is one of the group of four shafts ganged to naturalizing note programming button 9 as shown in FIG. 1. Shaft 63 is the equivalent to shaft 54 as shown in FIG. 9, and when depressed uncovers a hole 64 preparing the instrument to produce the tone C sharp. Simultaneously, slide cover 57 is urged upwards by the tension in wire 60 created by depressing shaft 63. In all other respects, the mechanism for the C tonal group depicted in FIG. 10 is identical with the mechanism for the E tonal group depicted in FIGS. 8 and 9.

One of the advantages is a musical instrument semipermanently programmable to provide tone designated by the key signature of a composition eliminating the need for mental transposing.

A further advantage is a wood wind instrument capable of producing accessory tones without disturbing the key setting mechanism.

Still another advantage is a wood wind instrument which naturalizes all the tones when depressing two scale buttons.

A further advantage is a wood wind instrument which raises each note an octave higher upon depressing a single octave bar.

Another advantage is a wood wind instrument complete with a mechanism quickly programming the natural tone to either associated half tone.

Thus, there is disclosed in the above description and in the drawings, an embodiment of the invention which fully and effectively accomplishes the objects thereof. However, it will be apparent, to those skilled in the art, how to make variations and modifications to the instant invention. Therefore, this invention is to be limited not by the specific disclosure herein, but only by the appending claims.

The embodiment of the invention in which an exclusive privilege or property is claimed are defined as follows.

I claim:

1. A wind musical instrument comprising a hollow tube having a bell shaped termination, a plurality of holes along the length of said tube, first hole covering means manually independently operable by depression of buttons, first number of holes uncoverable upon depression of said buttons, said first hole covering means biased to cover said first number of holes when said buttons are undepressed, said first number of holes capable of producing one octave of musical tones containing seven natural sequential tones and five intermediary half tones, seven second hole covering means each manually independently operable by depressing one of seven keys associated therewith, slide hole covers uncoverable by depression of said keys, said second hole covering means biased to cover said slide hole covers when in hole covering position when said keys are undepressed, a second number of holes beneath said slide hole covers, said slide hole covers each selectively manually displaceable into a displaced position uncovering the associated hole in said second number of holes, said slide hole covers individually operated by programming means, said programming means adapted to selectively individually displace into said displaced position said slide hole covers, six of said seven second hole covering means each covering three slide hole covers constituting a tonal group complex, each of said three slide hole covers adapted to cover and uncover into said displaced position a hole in said tonal group complex, independent means to selectively uncover the middle slide hole cover into said displaced position and simultaneously cover the remaining two slide hole covers within each of said six tonal group complexes, said middle slide hole cover associated with each of said six tonal group complexes when uncovered into said displaced position exposes one of said second member of holes adapted to produce one of six successive natural tones within a musical scale, two slide hole covers adjacent said middle slide hole cover within each of said six tonal group complexes uncover two of said second number of holes adapted to produce respectively the half tone below and above said natural tone when two slide hole covers are operated independently of each other in said displaced position, the seventh of said seven second hole covering means covers two slide hole covers constituting the C natural tonal group complex, each of said two slide hole covers in said seventh second hole covering means adapted to cover and uncover into said displaced position a hole in said C tonal group complex, means to cover said two slide hole covers within said C tonal group complex, the length of said tube adapted to produce the C natural tone when all holes in said first number of holes and all holes in said second number of holes are covered, one of said two slide hole covers within said C tonal group complex adapted to produce the half tone below the C natural tone, the other of said two slide hole covers within said C tonal group complex adapted to produce the half tone above said C natural tone, means to selectively cover said middle hole within each of said six tonal group complexes upon uncovering into the displaced position one of said adjacent slide hole covers, means to cover the hole associated wit one of said adjacent slide hole covers a tonal group complex upon locating the other adjacent slide hole cover into said displaced position, means to locate into hole covering position one of the said two slide hole covers within said C tonal group complex upon locating the other of said two slide hole covers within said C tonal group complex into said displaced position, operation of linkage means adapted to simultaneously locate into the hole covering position said two slide hole covers within said C tonal group complex, means to produce the half tone above said middle natural tone within said six natural tone group complexes upon operating an adjacent slide cover into said displaced position, means to produce the half tone below the middle natural tone within said six natural tone group complexes upon operating the other adjacent slide cover into the displaced position, manually operated first ganging means adapted to simultaneously operate three of the said six middle slide hole covers and said linkage means into said displaced position, manually operated second ganging means adapted to simultaneously operate the remaining three of said six middle slide hole covers into said displaced position, said first ganging means adapted to include the C-E-G-B tonal group complexes, said second ganging means adapted to include the D-F-A tonal group complexes, lever means adapted to uncover an octave hole located intermediate the mouthpiece end of said tube and all of said second number of holes, uncovering means for said octave hole producing a tone one octave higher than the tone otherwise produced by uncovering a single hole in said first number of holes or said second number of holes when said octave hole is covered.

2. The wind musical instrument of claim 1 further comprising first number of depressable programming buttons individually adapted to operate said adjacent slide hole covers in said six tonal group complexes and said C tonal group complex.

3. The wind musical instrument of claim 1 further comprising a first unitary depressable programming button adapted to operate said first ganging means.

4. The wind musical instrument of claim 1 further comprising a second unitary depressable programming button adapted to operate said second ganging means.

5. The wind musical instrument of claim 1 wherein a portion of said tube having said plurality of holes and said first hole covering means and said first member of hole biasing means and said seven second hole covering means and said second number of hole biasing means and said slide hole covers and said programming means and said selective means to uncover said adjacent slide covers into said displaced position and said means to uncover both of said two slide hole covers within said C tonal group complex and said linkage means and said first ganging means and said second ganging means and said lever means and said octave hole uncovering means confined within an enclosure.

6. The wind musical instrument of claim 1 wherein said first number of depressable programming buttons and said first unitary depressable programming button and said secondary unitary depressable programming button and said buttons each adapted for vertical depression above the upper lateral surface of said enclosure.

7. The wind musical instrument of claim 5 further comprising extensible legs fastened to the lowermost surface of said enclosure adapted to support said enclosure and said bell shaped termination and said mouthpiece end of said tube.

8. The wind musical instrument of claim 5 wherein a longitudinal edge of said uppermost lateral surface of said enclosure adapted to permit a portion of said keys to a position below said uppermost lateral surface when said keys are depressed, said keys having free ends extended beyond said longitudinal edge.

9. The wind musical instrument of claim 8 further comprising a longitudinal bar adapted to operate said lever means, said bar located below said free ends of said keys, said outermost longitudinal edge of said bar extending outwardly from said free ends of said keys, said longitudinal edge parallel to said free ends of said keys and to said outermost longitudinal edge of said bar.

10. The wind musical instrument of claim 1 wherein said first number of holes comprises twelve longitudinally sequential holes, seven of said twelve holes adapted to produce seven natural tones, five of said twelve holes located longitudinally intermediate said seven holes adapted to produce tones intermediate said seven natural tones, the first of said twelve holes located nearest said octave hole adapted to produce the B natural tone, the second of said twelve holes adapted to produce the intermediate tone A sharp or B flat, the third of said twelve holes adapted to produce the A natural tone, the fourth of said twelve holes adapted to produce the intermediate tone G sharp or A flat, the fifth of said twelve holes adapted to produce the G natural tone, the sixth of said twelve holes adapted to produce the intermediate tone F sharp or G flat, the seventh of said twelve holes adapted to produce the F natural tone, the eighth of said twelve holes adapted to produce the E natural tone, the ninth of said twelve holes adapted to produce the intermediate tone D sharp or E flat, the tenth of said twelve holes adapted to produce the D natural tone, the eleventh of said twelve holes adapted to produce the intermediate tone C sharp or D flat, the twelfth of said twelve holes adapted to produce the C natural tone.

11. The wind musical instrument of claim 10 adapted with a B sharp tone producing hole intermediate said octave hole and said first of said twelve holes.

* * * * *